US005511460A

United States Patent [19]

Custer

[11] Patent Number: 5,511,460

[45] Date of Patent: Apr. 30, 1996

[54] STROKE LIMITER FOR HYDRAULIC ACTUATOR PISTONS IN COMPRESSION RELEASE ENGINE BRAKES

[75] Inventor: Dennis R. Custer, West Granby, Conn.

[73] Assignee: Diesel Engine Retarders, Inc., Wilmington, Del.

[21] Appl. No.: 377,902

[22] Filed: Jan. 25, 1995

[51] Int. Cl.[6] ..... F15B 15/22; F02D 13/04

[52] U.S. Cl. ..... 91/401; 123/90.12; 123/321

[58] Field of Search ..... 91/49, 401; 123/90.12, 123/321, 323

[56] References Cited

U.S. PATENT DOCUMENTS

| | | | |
|---|---|---|---|
| 3,220,392 | 11/1965 | Cummins . | |
| 3,236,157 | 2/1966 | Lovell et al. | 91/49 X |
| 3,405,699 | 10/1968 | Laas | 123/90.12 X |
| 4,399,787 | 8/1983 | Cavanagh | 123/321 |
| 4,423,712 | 1/1984 | Mayne et al. | 123/321 |
| 4,742,806 | 5/1988 | Tart, Jr. et al. | 123/322 |
| 4,898,128 | 2/1990 | Meneely | 123/90.12 |
| 5,146,890 | 9/1992 | Gobert et al. . | |
| 5,161,501 | 11/1992 | Hu | 123/321 X |
| 5,201,290 | 4/1993 | Hu | 123/321 |

*Primary Examiner*—John E. Ryznic
*Attorney, Agent, or Firm*—Fish & Neave; Robert R. Jackson

[57] ABSTRACT

A clip valve for limiting the stroke of an exhaust-valve-operating hydraulic actuator piston in a compression release engine brake has a plunger which follows the actuator piston down until the motion of the plunger is stopped by a retaining ring in a bore in which the plunger reciprocates. When the plunger is thus stopped, an aperture in the slave piston is uncovered, thereby allowing pressurized hydraulic fluid to escape from the actuator piston cylinder and preventing further downward motion of the actuator piston. The clip valve apparatus is constructed to facilitate assembly of the plunger and retaining ring in the bore, as well as to provide secure and fail-safe retention of those components in the bore. The parts of the clip valve are simplified and preferably also reduced in number as compared to the prior art.

15 Claims, 3 Drawing Sheets

70
66
80
42
20
24
30
22
50
78
72
74
60
62
40

70
78
64
62
40
24
20
30
22
50
72
76
80
60
42

STROKE LIMITER FOR HYDRAULIC ACTUATOR PISTONS IN COMPRESSION RELEASE ENGINE BRAKES

BACKGROUND OF THE INVENTION

This invention relates to compression release brakes for internal combustion engines, and more particularly to improvements to the hydraulic circuit apparatus typically used in such brakes.

Compression release brakes for internal combustion engines are well known as shown, for example, by Cummins U.S. Pat. No. 3,220,392. In the typical compression release engine brake hydraulic circuits are provided for transferring appropriately timed motions of the engine to exhaust-valve-opening portions of the engine to cause the associated exhaust valves to open near top dead center of compression strokes of the associated engine cylinders. This hydraulic circuitry is only rendered operative when engine braking is desired and the flow of fuel to the engine is accordingly cut off. Opening the exhaust valves in this manner allows air that has been compressed in the cylinders to escape from the cylinders to the exhaust system of the engine before the engine can recover the work of compressing that air during the subsequent "power" strokes of the cylinders. The engine brake therefore temporarily converts the engine from a power source to a power-absorbing air compressor, and the engine is thereby made much more effective in slowing down a vehicle propelled by the engine. This prolongs the life of the vehicle's wheel brakes and increases the safety of operation of the vehicle.

The horsepower that an engine can absorb during compression release engine braking is strongly influenced by the timing of the exhaust valve openings relative to top dead center of the compression strokes of the associated engine cylinders. For optimum braking it is important that these exhaust valve openings be properly timed and that the exhaust valves open rapidly by an amount that is adequate to quickly release the air compressed in the associated engine cylinders. It must also be remembered that during compression release engine braking the exhaust valves must be opened against considerable resistance due to the high pressure of the air in the engine cylinders when compression release events are to be produced. All of the foregoing considerations necessitate that the engine brake hydraulic circuit associated with each engine cylinder be capable of rapidly applying a large hydraulic force to the hydraulic actuator piston that causes the exhaust valve or valves in that engine cylinder to open. The hydraulic circuit must be able to drive the actuator piston forcefully and rapidly to produce a rapid and substantial opening of the associated exhaust valve(s).

On the other hand, it may be very important to limit the stroke of the exhaust valves during compression release engine braking. This is so because during such braking the exhaust valves are opening when the top of the associated engine piston is closest to those valves (i.e., at the top dead center position). The exhaust valves must not contact the top of the associated engine piston or the engine will be damaged.

To ensure rapid and substantial but limited opening of the exhaust valves it is known to provide what is sometimes called a "clip valve" in each hydraulic circuit in a compression release engine brake. Such a clip valve allows hydraulic fluid to escape from each engine brake hydraulic circuit as soon as the actuator piston in that hydraulic circuit has travelled far enough to produce the desired maximum opening of the associated exhaust valve(s). Some examples of clip valves are shown in Hu U.S. Pat. No. 5,161,501. For example, in FIGS. 1 and 2 of the Hu patent a clip valve is shown in which a plunger 20 covers an aperture 12 in the top of slave piston 10 until the slave piston travels down beyond the limit of downward motion of the plunger established by pin 22. Aperture 12 is then uncovered, thereby allowing hydraulic fluid to escape from above slave piston 10 through the slave piston. This prevents further downward motion of the slave piston and limits the amount by which the associated engine exhaust valves are opened.

While several of the known clip valves have been highly successful, they may sometimes have certain disadvantages. For example, they tend to include a substantial number of parts, at least some of which require fairly complex machining and/or assembly. As an illustration of this the clip valve shown in FIGS. 1 and 2 of the Hu patent includes plunger 20, cross pin 22, nut 40, spring 50, and screw 70. Plunger 20 requires fairly complex machining (e.g., to produce elongated slot 28 for pin 22) and fairly complex assembly (e.g., to insert the plunger in screw 70 against the outward force of spring 50 and with the proper orientation to allow pin 22 to be passed through slot 28). There are also several possible failure modes for this apparatus. Pin 22 may come out of screw 70. Spring 50 may break. Screw 70 may break at the interface between engine brake housing 30 and nut 40 because screw 70 is weakened by being bored out for spring 50.

In view of the foregoing it is an object of this invention to provide simplified and improved clip valve apparatus for use in the hydraulic circuits of compression release brakes for internal combustion engines.

It is another object of this invention to provide compression release engine brake clip valves that have fewer parts, simpler machining, and easier assembly to lower the cost of the clip valves.

It is still another object of this invention to provide compression release engine brake clip valves that have reduced risk of breakage or failure, and which are therefore more robust and reliable in use.

SUMMARY OF THE INVENTION

These and other objects of the invention are accomplished in accordance with the principles of the invention by providing a clip valve assembly for the actuator piston in the hydraulic circuitry of a compression release engine brake, the clip valve assembly including a piston follower member or plunger that is preferably fairly loosely received in a bore in a stationary part of the engine brake (e.g., in the end of a return stop screw for the actuator piston). The plunger is retained in the bore by a retainer ring which is preferably a wire having a circular cross section. The plunger is reciprocable parallel to the axis of reciprocation of the actuator piston. The bottom of the plunger covers an aperture in the top of the actuator piston while the plunger is in contact with the top of the actuator piston. The above-mentioned retainer ring stops the downward motion of the plunger at the point at which the plunger should separate from the actuator piston to release hydraulic fluid from the actuator piston cylinder and thereby clip or terminate a forward stroke of the actuator piston.

The upper end of the plunger bears against a seat in the upper end of the bore when the return spring of the actuator piston is operative to push the plunger up into the bore. Thus the plunger itself provides the return stop surface for the actuator piston. Although a spring may be provided between the bore and the plunger to urge the plunger down toward the top of the actuator piston, in the more preferred embodiments no such spring is required. Hydraulic fluid is trapped and pressurized between the upper end of the plunger and the opposite portion of the bore at the end of each actuator piston return stroke. This trapped and pressurized hydraulic fluid is believed to help initiate downward motion of the plunger at the start of the next forward stroke of the actuator piston. As soon as the actuator piston begins to move down in response to high pressure hydraulic fluid in the actuator piston cylinder, there is a net downward hydraulic force on the plunger because of the relatively low pressure seen by the plunger in the above-mentioned aperture in the actuator piston. This net downward hydraulic force keeps the plunger moving down with the actuator piston until the above-mentioned retainer ring stops the plunger as previously explained.

The relatively loose fit of the plunger in the bore provides a simple way for hydraulic fluid to reach the upper surface of the plunger, as is required to produce the above-mentioned net downward hydraulic force on the plunger. This relatively loose fit also makes it possible for the plunger to angle itself slightly in the bore to conform to a possible incline of the top of the actuator piston. The plunger and bore are shaped to automatically seat the retainer ring during initial assembly of the apparatus. The plunger and bore are also shaped to virtually eliminate any possibility of the retainer ring being dislodged during operation of the apparatus. Because the need for a spring above the plunger is reduced or eliminated, the bore can be made shallower than in the prior art. If the bore is in a return stop screw for the actuator piston, the shallower bore in the screw makes the screw stronger and less likely to break at an interface between the engine brake housing and a nut which locks the screw to the housing.

Further features of the invention, its nature and various advantages will be more apparent from the accompanying drawings and the following detailed description of the preferred embodiments.

BRIEF DESCRIPTION OF THE DRAWINGS

FIG. 1 shows two different operating conditions of the apparatus on the left and right side, respectively.

DETAILED DESCRIPTION OF THE PREFERRED EMBODIMENTS

Figure 1:
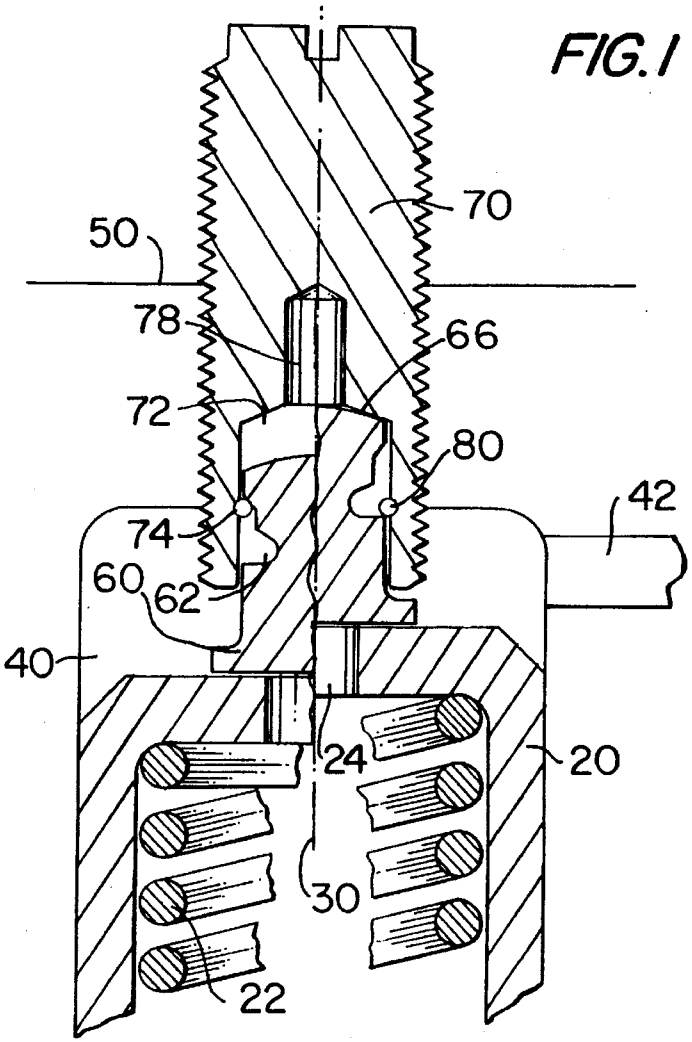
FIG. 1 is a simplified sectional view of illustrative clip valve apparatus constructed in accordance with the principles of this invention.
Figure 2:
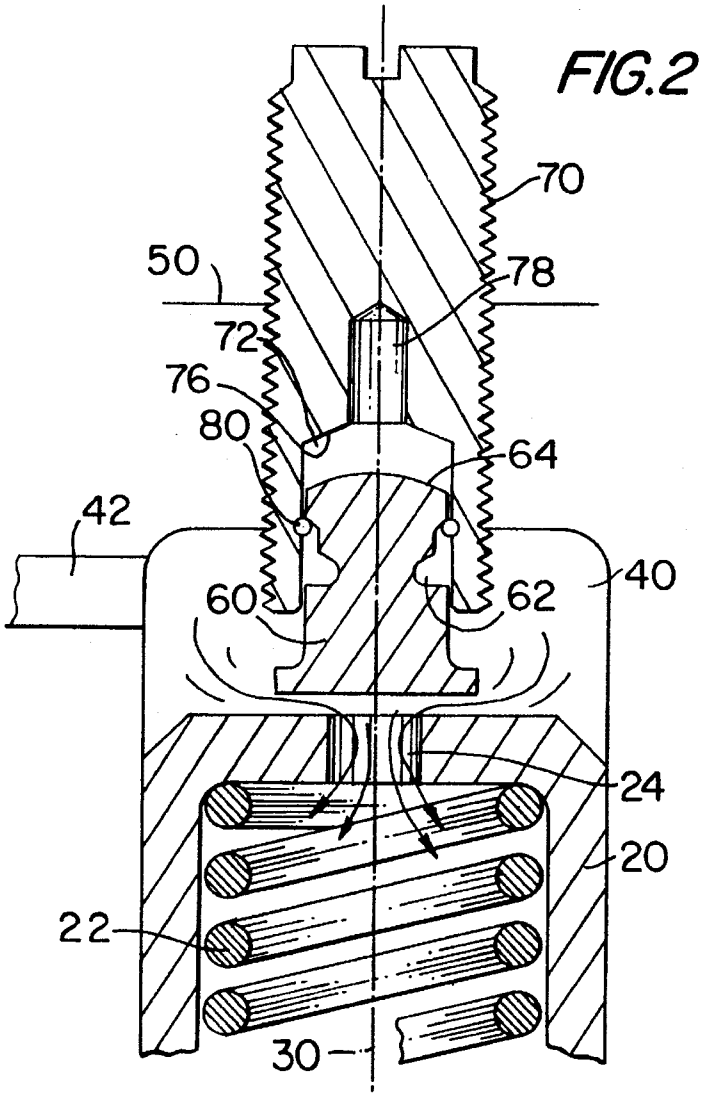
FIG. 2 is another view similar to FIG. 1 showing another operating condition of the apparatus.

As shown in FIGS. 1 and 2, an illustrative embodiment of the clip valve apparatus of this invention includes a hydraulic actuator piston 20 reciprocable along axis 30 in an actuator piston cylinder bore 40 in the housing 50 of a compression release engine brake. Actuator piston 20 is resiliently urged in the upward direction by return spring 22. Piston 20 has an aperture 24 through the center of its upper wall. Aperture 24 is normally covered by the bottom surface of clip valve plunger 60. Plunger 60 is partly received in a bore 72 in the lower portion of actuator piston return stop screw 70. Plunger 60 is reciprocable along axis 30 relative to screw 70. Screw 70 is threaded through housing 50 so that the lower portion of the screw and plunger 60 project into the upper portion of cylinder 40 by an adjustable amount. Screw 70 is typically locked into a desired location by a conventional lock nut (not shown) around screw 70 above housing 50, which lock nut is tightened down against the upper surface of the housing.

Plunger 60 is retained in bore 72 by a substantially annular retaining ring 80. In the particularly preferred depicted embodiment retaining ring 80 is made of wire which has a circular cross section. Retaining ring 80 is partly received in an annular groove 74 in the cylindrical side wall of bore 72. Indeed, retaining ring 80 is preferably resiliently biased to expand radially outwardly into groove 74. The cross section of groove 74 is preferably semi-circular to complement the outer surface of retaining ring 80. Groove 74 is only deep enough to receive about half the cross sectional area of retaining ring 80. The other half of the cross section of the retaining ring projects out into an annular groove 62 in the outer cylindrical side surface of plunger 60. This prevents plunger 60 from moving down farther than is shown on the left in FIG. 1 and also in FIG. 2. The preferred shape of groove 62 will be discussed in more detail below.

The upper portion of bore 72 includes a concave frustoconical shoulder 76 leading to a smaller terminal bore portion 78. The upper end surface 64 of plunger 60 is preferably spherically convex with a radius such that when plunger 60 is pushed fully into bore 72, surface 64 bears on shoulder 76 with a circular line of contact that is substantially concentric with axis 30. The intersection of this line of contact with the plane of the paper on which FIG. 1 is drawn is indicated by the cross 66 in FIG. 1. This fairly long, circular line of contact between surfaces 64 and 76 affords sufficient contact area to permit plunger 60 to be used as the return stop for actuator piston 20 when return spring 22 pushes the piston up. In other words, when the hydraulic fluid pressure in cylinder 40 is low enough to permit spring 22 to move piston 20 up, the upward motion of the piston stops when plunger surface 64 contacts shoulder surface 76.

Figure 3:
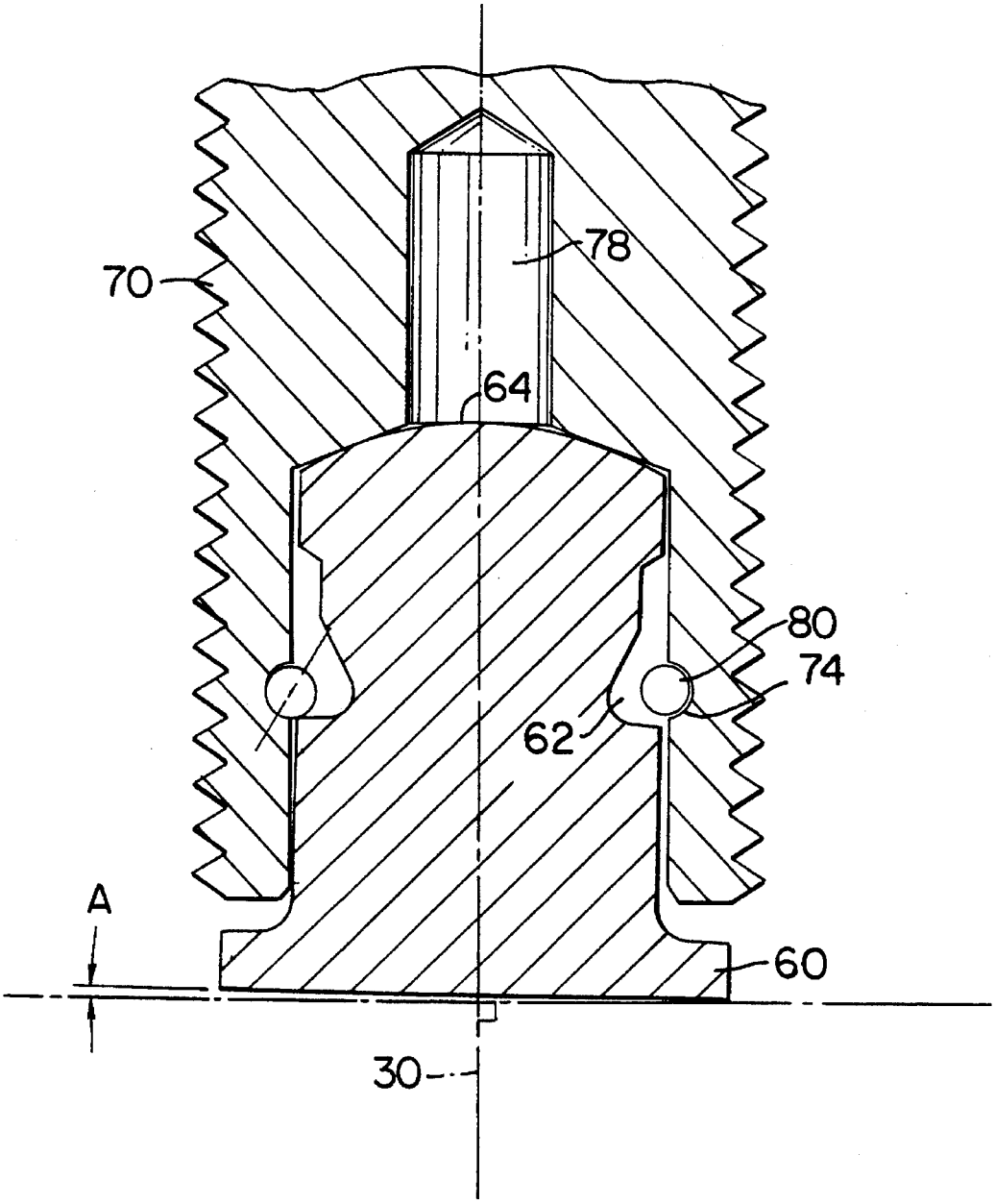
FIG. 3 is similar to a portion of FIG. 1 enlarged to show another possible operating aspect of the apparatus.

Plunger 60 preferably fits relatively loosely in bore 72 so that there is a substantial annular clearance between the cylindrical side surface of plunger 60 and the cylindrical side surface of bore 72. Among other advantages, this allows plunger 60 to cock or incline slightly in bore 72 as shown, for example, by angle A in FIG. 3 so that the bottom surface of the plunger provides a good seal for aperture 24 even if the various parts of the apparatus are not all perfectly aligned with one another. In the depicted preferred embodiment the bottom surface of plunger 60 may deviate by as much as about one degree from perpendicular to axis 30. This attribute of the apparatus is also facilitated by the use of spherical surface 64 seating against frustoconical surface 76. The exact location of the annular line of contact between surfaces 64 and 76 may shift when plunger 60 is cocked or inclined in bore 72, but essentially the same kind and amount of contact between surfaces 64 and 76 is always provided.

Figure 4:
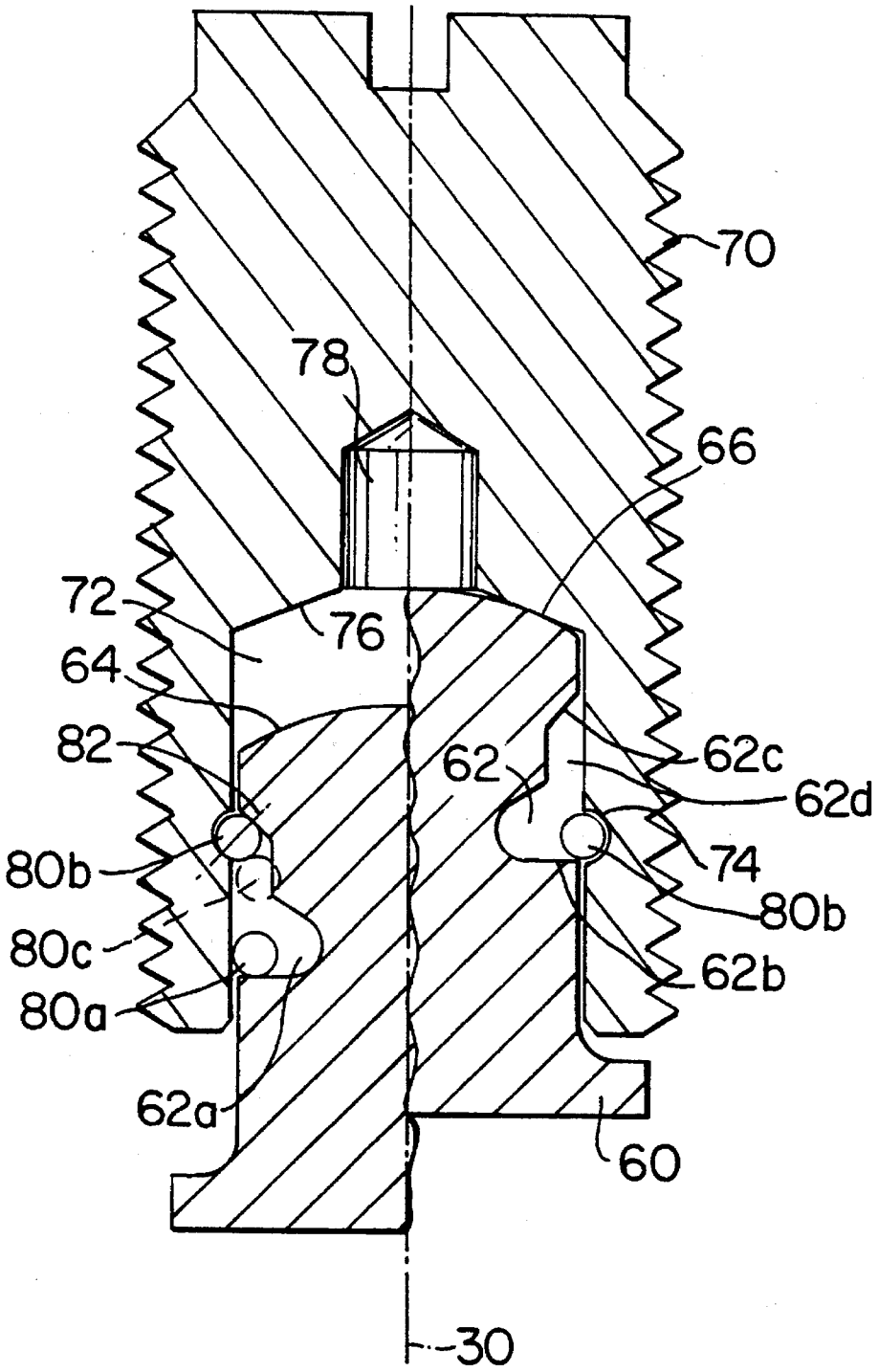
FIG. 4 is another view similar to a portion of FIG. 1 which is useful in explaining how the apparatus is assembled, as well as additional constructional and operational details of the apparatus.

FIG. 4 illustrates how the clip valve apparatus of this invention can be assembled, and also some other advantages of the preferred retaining ring structure. To assemble plunger 60 and retaining ring 80 in bore 72, the retaining ring is annularly compressed as shown at 80*a* in FIG. 4 so that it is entirely received within the relatively deep lower portion 62*a* of groove 62. The depth of groove portion 62*a* is more than twice the radius of the wire used to make retaining ring 80. This allows plunger 60 and retaining ring 80 to be pushed into bore 72. When the upper surface 64 of plunger 60 contacts surface 76, the lower edge 62*b* of groove 62 is adjacent the lower edge of groove 74. This allows retaining ring 80 to automatically spring out into groove 74 as shown at 80*b* in FIG. 4. Retaining ring 80 thereafter spans grooves 74 and 62. During subsequent operation of the apparatus, when plunger 60 moves down, the inclined upper edge 62*c* of groove 62 contacts retaining ring 80 and pushes the retaining ring against the lower side wall of groove 74. Retaining ring 80 therefore stops downward motion of plunger 60 at the position shown on the left in FIG. 4. The angle 82 of contact between elements 60, 80, and 70 is such that there is no tendency of retaining ring 80 to leave groove 74. But even if there were such a tendency, the upper part 62*d* of groove 62 is deliberately made too shallow to receive the full diameter of retaining ring 80 (i.e., the depth of groove portion 62*d* is more than the radius of the retaining ring wire but less than twice that radius). Thus the position of the retaining ring shown at 80*c* is impossible. This helps ensure that retaining ring 80 never leaves groove 74. Moreover, each completed return stroke of plunger 60 tends to return retaining ring 80 to groove 74 by virtue of the approximate alignment of the lower edge 62*b* of groove 62 with the lower edge of groove 74 each time surfaces 64 and 76 contact one another. The preferred plunger retention structure of this invention is therefore easily manufactured and assembled, and it provides very secure and fail-safe retention of plunger 60 in bore 72.

Turning now to other aspects of the operation of the apparatus of this invention, the initial condition of the apparatus is shown on the right in FIG. 1. Relatively low pressure hydraulic fluid is present in cylinder 40 and also in aperture 24. Return spring 22 is therefore able to push actuator piston 20 and plunger 60 all the way up so that surfaces 64 and 76 contact one another. The lower surface of plunger 60 seals aperture 24.

When it is desired to produce a compression release event in the internal combustion engine cylinder associated with actuator piston 20, high pressure hydraulic fluid is introduced into cylinder 40 via conduit 42. This forces actuator piston 20 to move down. Plunger 60 initially travels down with the actuator piston, thereby keeping aperture 24 sealed and retaining high pressure hydraulic fluid in cylinder 72. Plunger 60 moves down in this way because the pressure in aperture 24 is always relatively low and because the high pressure in cylinder 40 is readily communicated to upwardly facing surfaces of the plunger (e.g., to surface 64) via the relatively large clearance between the cylindrical sides of plunger 60 and bore 72. Thus there is a net downward hydraulic force on plunger 60 which causes it to move down with actuator piston 20, thereby keeping the aperture 24 in the actuator piston closed. The above-described downward motion of piston 20 opens one or more exhaust valves in the associated internal combustion to produce a compression release event in the engine in the usual manner for compression release braking of the engine.

When the desired amount of exhaust valve opening has been produced in the engine, the upper side wall 62*c* (FIG. 4) of groove 62 contacts retaining ring 80 as shown on the left in FIGS. 1 and 4. This prevents any further downward motion of plunger 60. Actuator piston 20 can, however, continue to move down. But this only serves to uncover aperture 24 as shown in FIG. 2, thereby allowing high pressure hydraulic fluid to escape from cylinder 40. Any significant further downward motion of actuator piston 20 is thereby prevented, and the amount by which the associated engine exhaust valves can open is accordingly limited. On the other, hand actuator piston 20 tends to remain down and the associated exhaust valves remain open until cylinder 40 is more fully depressurized via conduit 42 when it is desired to end the compression release opening of the exhaust valves.

When the cylinder 40 is thus depressurized via conduit 42, return spring 22 can push actuator piston 20 and plunger 60 up to their initial positions shown on the right in FIGS. 1 and 4. The final portion of this return motion of plunger 60 is believed to trap and pressurize some hydraulic fluid in the upper portion 78 of bore 72. This hydraulic fluid pressure is available to help initiate the next downward stroke of plunger 60, which typically occurs only a small fraction of a second later when the next compression release event is to be produced. It has therefore not been found necessary to include a spring between elements 60 and 70 to push down on plunger 60. However, such a spring can be included if desired.

It will be understood that the foregoing is only illustrative of the principles of this invention and that various modifications can be made by those skilled in the art without departing from the scope and spirit of the invention. For example, while it has been assumed that the engine cylinder valves opened by actuator piston 20 are conventional engine exhaust valves, actuator piston 20 can instead be used to open a special valve provided in each engine cylinder just for the purpose of producing compression release events (see, for example, Gobert U.S. Pat. No. 5,146,890). However, such special-purpose valves are very much like conventional exhaust valves, and so it will be understood that they are included within the term "exhaust valve" as that term is used herein. It will also be understood that any suitable source can supply the appropriately timed pressurized hydraulic fluid pulses in conduit 42. For example, these pulses can be supplied by a master piston operated by another moving part of the associated internal combustion engine as shown in the above-mentioned Cummins patent and other such references. Or these pulses can be supplied from an electrically operated trigger valve as shown, for example, in commonly assigned applications Ser. No. 08/319,734, filed Oct. 7, 1994, and Ser. No. 08/320,049, filed Oct. 7, 1994.

The invention claimed is:

1. Apparatus for limiting the stroke of a piston in a hydraulic actuator cylinder due to introduction of pressurized hydraulic fluid into said cylinder adjacent an end surface of said piston, said end surface being substantially perpendicular to the axis along which said piston moves in response to said pressurized hydraulic fluid, and said end surface having an aperture through which hydraulic fluid can escape from said cylinder when said aperture is opened, said aperture comprising:

a piston follower member movably mounted in said cylinder between said end surface and an end of said cylinder which faces said end surface, said member being movable relative to said cylinder and said piston substantially parallel to said axis, a first end of said member being disposed adjacent said end surface and being shaped to selectively close said aperture and thereby prevent hydraulic fluid from escaping from said cylinder via said aperture, and a second end of said member which faces away from said first end being shaped to selectively bear on said end of said cylinder and thereby enable said member to act as a stop for stopping motion of said piston toward said end of said cylinder when said end surface contacts said first end and said second end contacts said end of said cylinder; and a stop structure for limiting the amount by which said member can travel with said piston away from said end of said cylinder so that when said stop structure is operative, said member is prevented from continuing to move away from said end of said cylinder with said piston and said aperture is accordingly opened to release hydraulic fluid from said cylinder and thereby prevent said piston from continuing to move in response to hydraulic fluid pressure in said cylinder.

2. The apparatus defined in claim 1 wherein a portion of said member adjacent said second end is slidably received in a bore in said end of said cylinder.

3. The apparatus defined in claim 2 wherein there is an annular clearance between the side wall of said bore and the adjacent side surface of said member.

4. The apparatus defined in claim 3 wherein said clearance allows hydraulic fluid in said cylinder to reach said second end.

5. The apparatus defined in claim 3 wherein said clearance allows said member to incline by a limited amount relative to said axis.

6. The apparatus defined in claim 2 wherein said stop structure comprises:

a first annular channel concentric with said axis in the side wall of said bore;

a second annular channel concentric with said axis in the surface of said member adjacent to said first channel; and a substantially annular retainer member concentric with said axis and disposed in said first and second channels so that a first portion of each cross section of said retainer member is in said first channel and a second portion of each cross section of said retainer member is in said second channel.

7. The apparatus defined in claim 6 wherein said retainer member is a round wire having a predetermined cross sectional radius.

8. The apparatus defined in claim 7 wherein said first channel has a semi-circular cress section having approximately the same radius as said wire.

9. The apparatus defined in claim 8 wherein said second channel has a cross section having a first portion adjacent to said first end which is at least twice as deep as the radius of said wire, and wherein said cross section of said second channel has a second portion adjacent to said second end which is deeper than the radius of said wire but shallower than twice the radius of said wire.

10. The apparatus defined in claim 9 wherein said first and second channels are located relative to one another so that when said second end of said member bears against said end of said cylinder, the edge of said second channel which is closer to said first end is adjacent to the edge of said first channel which is also closer to said first end.

11. The apparatus defined in claim 7 wherein the side wall of said second channel which is closer to said second end is inclined toward said first channel.

12. The apparatus defined in claim 6 wherein said retainer member is resiliently biased to expand annularly outward into said first channel.

13. The apparatus defined in claim 1 wherein said second end is shaped to trap a quantity of hydraulic fluid between said second end and said end of said cylinder when said second end bears on said end of said cylinder.

14. The apparatus defined in claim 2 wherein said bore is formed in an end portion of an adjustment screw that is threaded into said end of said cylinder.

15. The apparatus defined in claim 1 wherein said second end is spherically convex, and wherein said end of said cylinder on which said second end bears is conically concave so that a substantially circular line of contact is formed between said second end and said end of said cylinder when said second end bears on said end of said cylinder.

* * * * *